US005816129A

United States Patent [19]

Singer

[11] Patent Number: 5,816,129

[45] **Date of Patent: *Oct. 6, 1998**

[54] MITER FENCE FOR RADIAL ARM SAW

[76] Inventor: David K. Singer, 1130 Chandler St., Madison, Wis. 53715

[ * ] Notice: This patent issued on a continued prosecution application filed under 37 CFR 1.53(d), and is subject to the twenty year patent term provisions of 35 U.S.C. 154(a)(2).

[21] Appl. No.: 574,710

[22] Filed: Dec. 19, 1995

[51] Int. Cl.[6] ..... B26D 7/02

[52] U.S. Cl. ..... 83/468.3; 83/581

[58] Field of Search ..... 83/581, 574, 486.1, 83/468.3, 745

[56] References Cited

U.S. PATENT DOCUMENTS

| | | | |
|---|---|---|---|
| 2,485,274 | 10/1949 | Garrett | 83/468 |
| 2,770,265 | 11/1956 | Pollock | 83/468.3 |
| 2,803,271 | 8/1957 | Shaw | 83/468.3 |
| 2,890,729 | 6/1959 | Horn | 269/315 |
| 2,895,515 | 7/1959 | Ende | 83/468.3 X |
| 3,344,819 | 10/1967 | Mitchell | 83/468.3 X |
| 3,466,025 | 9/1969 | Kimber | 83/471.3 X |
| 3,498,345 | 3/1970 | Sexton | 83/471.2 |
| 3,738,211 | 6/1973 | Carter, Sr. | 83/468.3 X |
| 3,901,115 | 8/1975 | Vizziello et al. | 83/468.3 X |
| 3,901,498 | 8/1975 | Novak | 83/471.3 X |
| 3,964,361 | 6/1976 | Allaire | 83/471.3 |
| 4,206,910 | 6/1980 | Biesemeyer | 269/236 |
| 4,378,716 | 4/1983 | Volk | 83/574 X |
| 4,519,280 | 5/1985 | Cook | 83/574 X |
| 4,521,006 | 6/1985 | Waters | 83/468 X |
| 4,558,618 | 12/1985 | Bachmann et al. | 83/438 |
| 4,593,590 | 6/1986 | Gray | 83/438 |
| 4,745,834 | 5/1988 | Neumann | 83/468 |
| 4,751,865 | 6/1988 | Buckalew | 83/574 X |
| 4,800,793 | 1/1989 | McCord, Sr. | 83/468.1 X |
| 4,895,059 | 1/1990 | Peterson et al. | 83/581 X |
| 5,062,339 | 11/1991 | Campos | 83/763 |
| 5,121,554 | 6/1992 | Havins | 83/471.3 X |
| 5,220,857 | 6/1993 | Freeburger | 83/468.3 |
| 5,228,374 | 7/1993 | Santeramo, Sr. | 83/438 |

FOREIGN PATENT DOCUMENTS

| | | |
|---|---|---|
| 3744716 | 6/1988 | Germany . |
| 2037655 | 7/1980 | United Kingdom . |
| 2137929 | 10/1984 | United Kingdom . |

*Primary Examiner*—Maurina T. Rachuba
*Attorney, Agent, or Firm*—Foley & Lardner

[57] ABSTRACT

A miter fence system for use with radial arm and other power saws is provided. The miter fence allows angled cuts to be made on a radial arm saw without having to adjust or move the radial arm of the saw. The miter fence system of the present invention includes a base fence unit which may be secured to the saw table of a radial arm saw in a conventional manner. The base fence unit includes an open portion which will not be contacted or damaged by the saw blade. Attached to the base fence unit are miter arm base units, which may be slid along the base fence unit in order to move the miter arm base units close to or away from the path of the saw blade. Swinging miter arm units are connected in a hinged relation to the miter arm base units. The swinging miter arm units may be rotated with respect to the miter arm base units to adjust the cutting angles. Miter gauge slides are preferably used to connect the swinging miter arm units and miter arm base units at a second point to allow adjustment of the swinging miter arm unit angles and to secure the swinging miter arm units in a desired angled position with respect to the miter arm base units.

8 Claims, 8 Drawing Sheets

MITER FENCE FOR RADIAL ARM SAW

FIELD OF THE INVENTION

This invention pertains generally to power saws such as radial arm saws and attachments therefore; and, more particularly, to power saw attachments for making angled or mitered cuts.

BACKGROUND OF THE INVENTION

A radial arm saw is a power saw generally used in the arts of woodworking, carpentry, etc. A radial arm saw allows precision cuts to be made because the work piece is held firmly in place while it is being cut by the saw. The radial arm saw thus represents an improvement over the table saw, wherein the work piece is moved through the saw blade to cut the work piece. In the radial arm saw, the motorized saw blade is mounted on a track whereby the blade may be moved through the work piece on a pre-determined path. An accurate and precise cut is thereby achieved because there is less chance of the work piece shifting, since the work piece is held firmly during the cutting process, and because the saw blade is prevented from deviating from the correct course by the track in which it rides.

In cutting a piece of wood or other material with a radial arm saw, the motorized saw blade is brought forward along the radial arm track and across a radial arm saw table on which the workpiece rests. (Typically, there may be a slot in the saw table surface to accommodate and clear the saw teeth when making a cut.) To secure the work piece while the cut is being made, a guide fence is used. The typical guide fence is simply a piece of wood approximately ¾ inches thick and 2¼ inches high which is secured to the saw table. The work piece may then be held against the guide fence when the radial arm saw is brought forward across it. This simple fence structure allows the work piece, be it square, round, or curved in cross-section, to be firmly and securely held in its proper position such that an accurate cut may be made by the saw.

Although the radial arm saw is capable of making precise cuts, it is not particularly well suited for use in making many cuts of varying angles. The track in which the motorized saw blade of the radial arm saw rides is mounted in a radial arm which is supported at one end by an upright column. The angle of the radial arm with respect to this column, and therefore with respect to the saw table, can typically be adjusted for making angled or mitered cuts. However, the process of moving the radial arm, which is necessarily large and heavy for stable cutting, is relatively awkward, complex, and time-consuming, and can become tedious if many angle adjustments need to be made in a short period of time. Also, the selection of a cutting angle by moving the radial arm often requires repeated adjustments to the arm angle. The radial arm must also be properly reset in order to ensure the accuracy of square cuts which are made later. Moreover, as the angle of the radial arm is adjusted, the path of the saw blade across the saw table and through the fence is also altered. Thus, repeated changing from one angled cut to another will gradually cut the guide fence to pieces. This destruction of the standard wooden fence will be even more rapid when wide blades for making dado or rabbet cuts are used, or when the saw blade is tilted, as well as angled, to make compound miter cuts. This damage to the fence will require that the fence be replaced after several different angle cuts have been made, so that an intact fence which is sufficiently solid to securely rest a work piece up against is maintained. Replacement of the guide fence is a time consuming process, and repeated replacement of the fence adds to the costs of operating the radial arm saw.

Another disadvantage of making angled cuts with the radial arm saw by adjusting the angle of the radial arm involves the making of left angle cuts. A typical right-handed operator of a radial arm saw will secure a work piece to be cut against the fence with his left hand and then pull the saw blade across the work piece with his right hand. When the radial arm of the saw is rotated to the left side of the saw table, to make a left side miter angle cut, the amount of fence and work surface remaining between the edge of the saw table and the path of the saw blade is significantly reduced. The resulting poor and awkward working conditions make it difficult for the operator to hold the work piece securely in place, thereby making it difficult to manage precision cuts.

Some of the disadvantages of making angled cuts with the radial arm saw can be overcome by using another type of powered saw for making angled cuts, such as a Motorized Miter Box or a Saw Buck. Alternatively, hand-held power tools may be used to perform the angled cuts. These solutions may not be practical in terms of the amateur do-it-yourself woodworker or hobbyist who can not be expected to have ready access to a multitude of different power tools. Moreover, with some of these alternative power tools for making angled cuts, e.g., the Motorized Miter Box, the size of the work piece which can be cut is limited. Also, for hand-held tools in particular, accurate cutting of the work piece can not be achieved to the same degree as is possible using a radial arm saw.

One solution to the problems associated with making angled cuts with a radial arm saw is, instead of changing the angle of the radial arm, changing the angle of the work piece with respect to the path of travel of the saw blade. This requires the use of a guide fence system having a guide fence (or fences) which may be secured at an angle with respect to the path of travel of the saw blade. An example of such a fence system is the miter table described in U.S. Pat. No. 3,901,498 to Novak. This patent describes a fence system for a radial arm saw which includes several fences attached at various angles to a table surface which is swung into position over the radial arm saw table during use. Most of the fences on the miter table are fixed in position. Movable fences, with adjustable angles, are achieved by securing one end of the movable fences to arcuate members which ride in a circular channel or arc groove cut into the table near its outer edge.

SUMMARY OF THE INVENTION

In accordance with the present invention an improved miter fence system for a radial arm saw, or other similar power saw device, is provided. The miter fence system of the present invention includes swinging miter arm units which permit accurate angled or miter cuts to be made on a radial arm saw without having to move the radial arm itself. The present invention provides a strong, solid, and stable miter fence system which allows a variety of angle cuts to be made on a radial arm saw without damaging the fence itself.

The miter fence system of the present invention may be mounted on a radial arm saw table in the place of a conventional radial arm saw guide fence. The miter fence system of the present invention includes a base fence unit which may be positioned in the groove between the front and back work surfaces of a conventional radial arm saw table, and secured there in a conventional manner using the bolt clamps provided as part of the radial arm saw table. Alternatively, or additionally, the miter fence system of the present invention may be secured to the radial arm saw table by the use of screws, bolts, or other fasteners which attach to the radial arm saw table through mounting holes in a self squaring lip portion which extends from the base fence unit. An open portion near the center of the base fence unit allows the radial arm saw blade to pass through the base fence unit without cutting the base fence unit. On the sides of the open portion of the base fence unit are protruding portions which extend above the surface of the saw table. Attached to the protruding portions of the base fence unit, preferably on either side of the open portion, are miter arm base units. The miter arm base units may be attached to the miter arm base fence unit in a manner whereby the base units may be slid toward or away from the path of the radial arm saw blade and then locked into position. This sliding/locking feature may be achieved by securing the miter arm base units to the base fence unit with bolts passing through key hole slots in the protruding portions of the base fence unit. Threaded tightening knobs attached to the bolts may be loosened for sliding the miter arm base units into a new position, and tightened for locking the miter arm base units into the desired position.

Swinging miter arm units are attached to the miter arm base units. The miter arm base units and swinging miter arm units are attached in a hinged relation at the ends of the miter arm base units and swinging miter arms which are closest to the path of travel of the radial arm saw blade. Near the opposite end of the miter arm base units and swinging miter arm units from the path of the saw blade, the miter arm base units and swinging miter arm units are connected by a mechanism which allows the angle of the swinging miter arm unit with respect to the miter arm base unit to be easily adjusted, and then secured in the desired angled position. This mechanism thus combines with the hinged connection to provide two support points for each swinging miter arm unit. An example of such a mechanism is a miter gauge slide which is secured at one end to the swinging miter arm unit. The miter gauge slide includes a central slot along its length. A threaded miter gauge pin is attached to the top surface of the miter arm base unit, and is positioned in the slot in the miter gauge slide. As the angle of the swinging miter arm unit is adjusted, the slot in the miter gauge slide is moved or slid with respect to the miter gauge slide pin. When the swinging miter arm unit is set at its desired position, a threaded tightening knob attached to the threaded miter gauge pin is tightened, thereby locking the swinging miter arm unit at its desired angle. The miter gauge slide may include stamped or printed degree increment markings to assist the user in setting the swinging miter arm unit at a desired angle.

The combination of the hinge connection at one end of the swinging miter arm unit, and the miter gauge slide connection near the other end of the swinging miter arm unit, secures the swinging miter arm unit at both ends, thereby providing a stable fence against which a work piece to be cut at an angle may be placed. Since the swinging miter arm unit is secured to the miter arm base unit, the swinging miter arm unit may be slid, along with the miter arm base unit, in a direction either toward or away from the cutting path of the radial arm saw. By locking the miter arm base unit in place, the swinging miter arm unit is also locked in the desired position. Thus, the position of the miter arm base units may be moved away from the path of the saw blade to accommodate wide radial arm saw attachments for making dado or rabbet cuts, etc., and in cases where the saw blade is tilted to make compound miter cuts. On the other hand, the miter arm base unit may be slid close to the cutting blade, to permit the best possible support of the work piece near where it is being cut to ensure a precise cut. Since the miter arm base units can be slid left to right over the open portion of the base fence unit, the saw blade need never contact the miter fence system, thereby preventing damage to the miter fence system and the necessity for periodic fence replacement.

The present invention thus provides a miter fence system which may be easily set up and adjusted to perform angle cuts using a radial arm saw. The angle of the swinging miter arm units can be easily adjusted and then locked in position. The work product is then held against the locked swinging miter arm unit which provides a stable fence for angled miter cuts. The angle of the swinging miter arm units may also be adjusted for straight angled cross cuts. A variety of angled cuts may, therefore, be performed without the need for adjusting the angle of the radial arm itself. The miter fence system of the present invention is long-lasting, because the saw blade never contacts the miter fence system. Even wide saw blade attachments, such as for making dado or rabbet cuts, may be used without damaging the miter fence system by simply sliding the miter arm base units back away from the blade path. Similarly, compound miter cuts may be made by tilting the saw blade to the left or right (a feature commonly available on many commercially available radial arm saws) and sliding the miter arm base units out of the path of the blade to prevent damage to the miter fence system. Since angled cuts can be made without moving the radial arm, more work space is provided to the operator for making left side angle cuts. For a miter fence system in accordance with the present invention having right and left swinging miter arm units, right and left miter angle cuts may be set up simultaneously. Since the angle of the swinging miter arm units can be both adjusted and locked in place, the present invention allows repetitious cuts of the same angle to be made, while also providing for easy adjustment of the swinging miter arm unit angles to produce cuts of different angles. The miter fence system of the present invention may be simply and inexpensively manufactured from a variety of materials, including wood, metal, or hard plastic.

Since the miter fence system of the present invention takes the place of the traditional fence guide used with the radial arm saw, it does not affect the existing capabilities of the radial arm saw or its other attachments. The miter fence system of the present invention thus makes the radial arm saw a more competitive alternative to the Saw Buck and Motorized Compound Miter Saws. The special capability of the radial arm saw, with the proper attachments, to do rip saw work, dado cuts, sanding, etc., is improved by the present invention which allows the radial arm saw to be quickly and easily set up for multiple operations at varying angles.

Further objects, features, and advantages of the present invention will be apparent from the following detailed description taken in conjunction with the accompanying drawings.

DETAILED DESCRIPTION OF THE INVENTION

Figure 1:
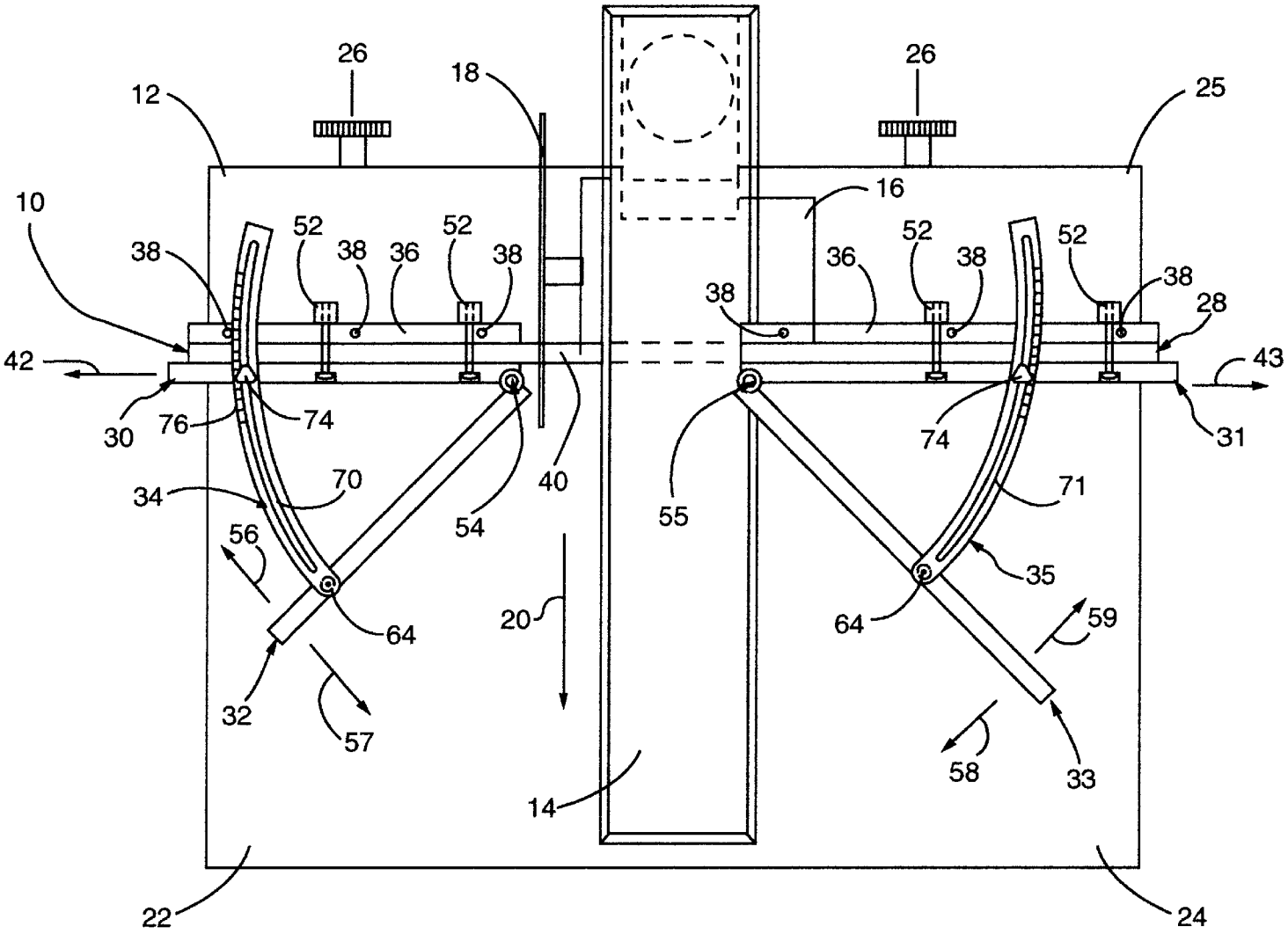
FIG. 1 is a plan view of the miter fence system of the present invention installed on a radial arm saw.

A miter fence system in accordance with the present invention is shown generally at 10 in FIG. 1. The miter fence system 10 is shown installed on a conventional radial arm saw 12. The radial arm saw 12 includes an upright column (not shown) carrying a radial arm 14. On the underside of the radial arm 14 is a track in which a motor yolk (not shown) supporting a motor 16 which drives a radial arm saw blade 18 is carried. A handle (not shown) attached to the yolk or the motor 16 allows the motor 16 and the radial arm saw blade 18 to be brought forward along the radial arm in the direction indicated by the arrow 20 to thereby cut in a cross-wise fashion a work piece made of wood or other material which is placed beneath the radial arm 14. The work piece to be cut is supported on a saw table 22 beneath the radial arm 14. The saw table 22 typically has front and back work surfaces 24 and 25 separated by a gap or groove (not shown) in which the miter fence system 10 of the present invention may preferably be mounted. Clamping screws located beneath the saw table 22 allow the front and back work surfaces 24 and 25 to be brought together, to close the gap between them, by tightening the clamping screw knobs 26. Thus, the miter fence system 10 of the present invention is secured in place on the radial arm saw table 22 by placing the miter fence system 10 on the saw table 22 in the gap between the front and back work surfaces 24 and 25 and then bringing the work surfaces together by tightening the clamping screws at the clamping screw knobs 26. The miter fence system 10 is thus clamped between the front and back work surfaces 24 and 25. This is the same way in which a normal fence guide would be secured to a typical radial arm saw 12 and makes possible the easy replacement of conventional fence system guides with the miter fence of the present invention. Of course, the miter fence system 10 of the present invention may be attached to a radial arm saw in any manner which is convenient and which provides secure support for the miter fence system 10.

Figure 2:
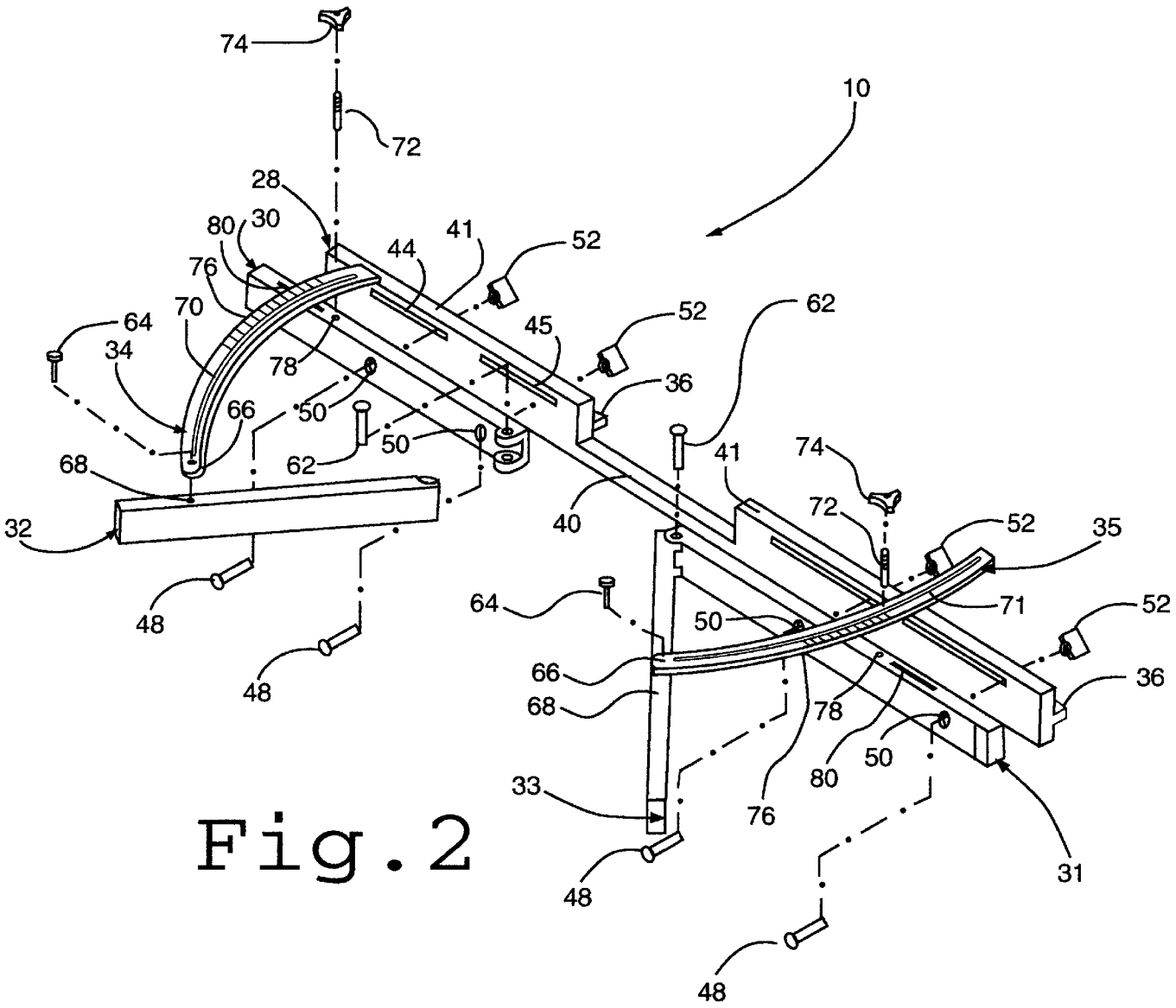
FIG. 2 is an exploded perspective view of the miter fence system of the present invention.
Figure 3:
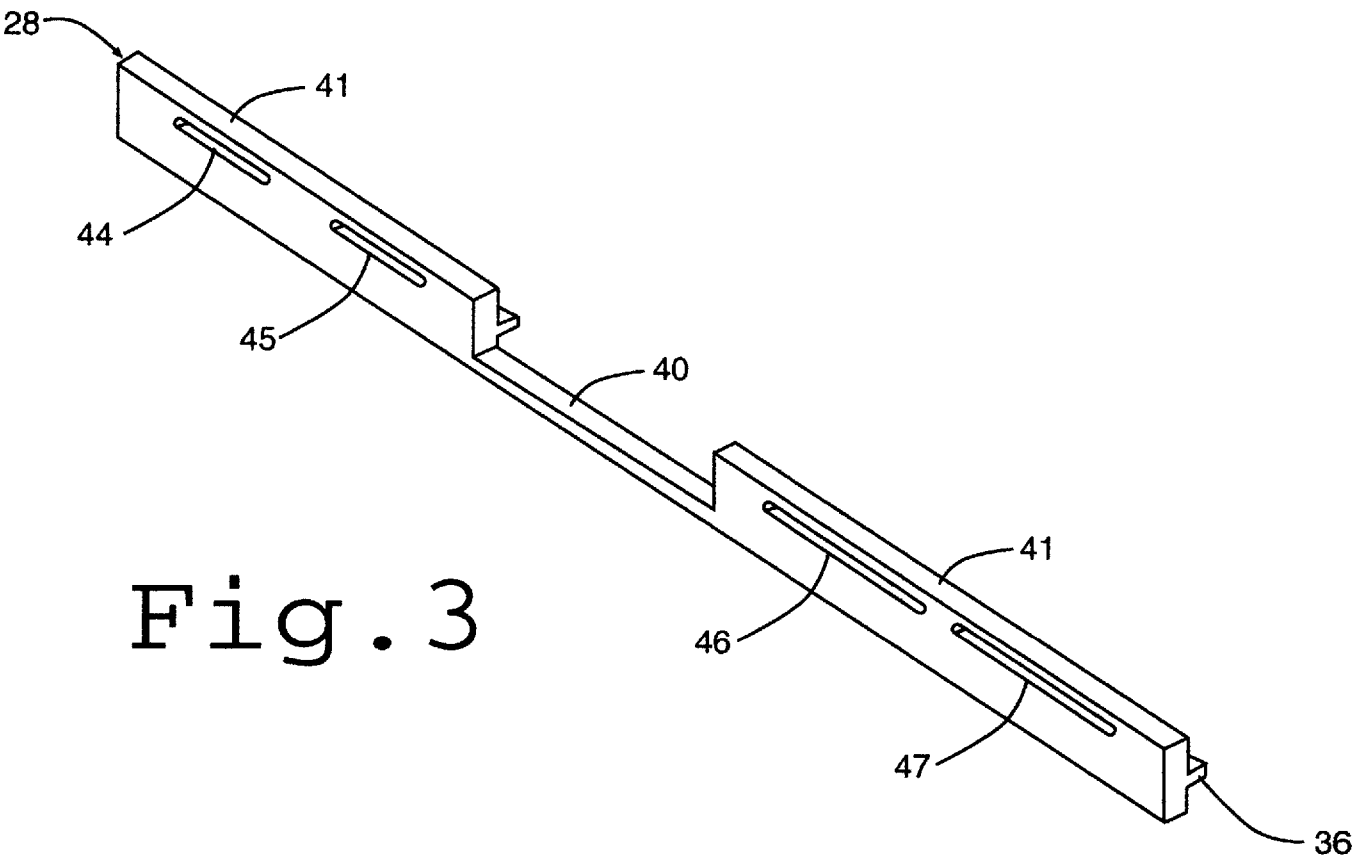
FIG. 3 is a front perspective view of the base fence unit of the miter fence system of the present invention.
Figure 4:
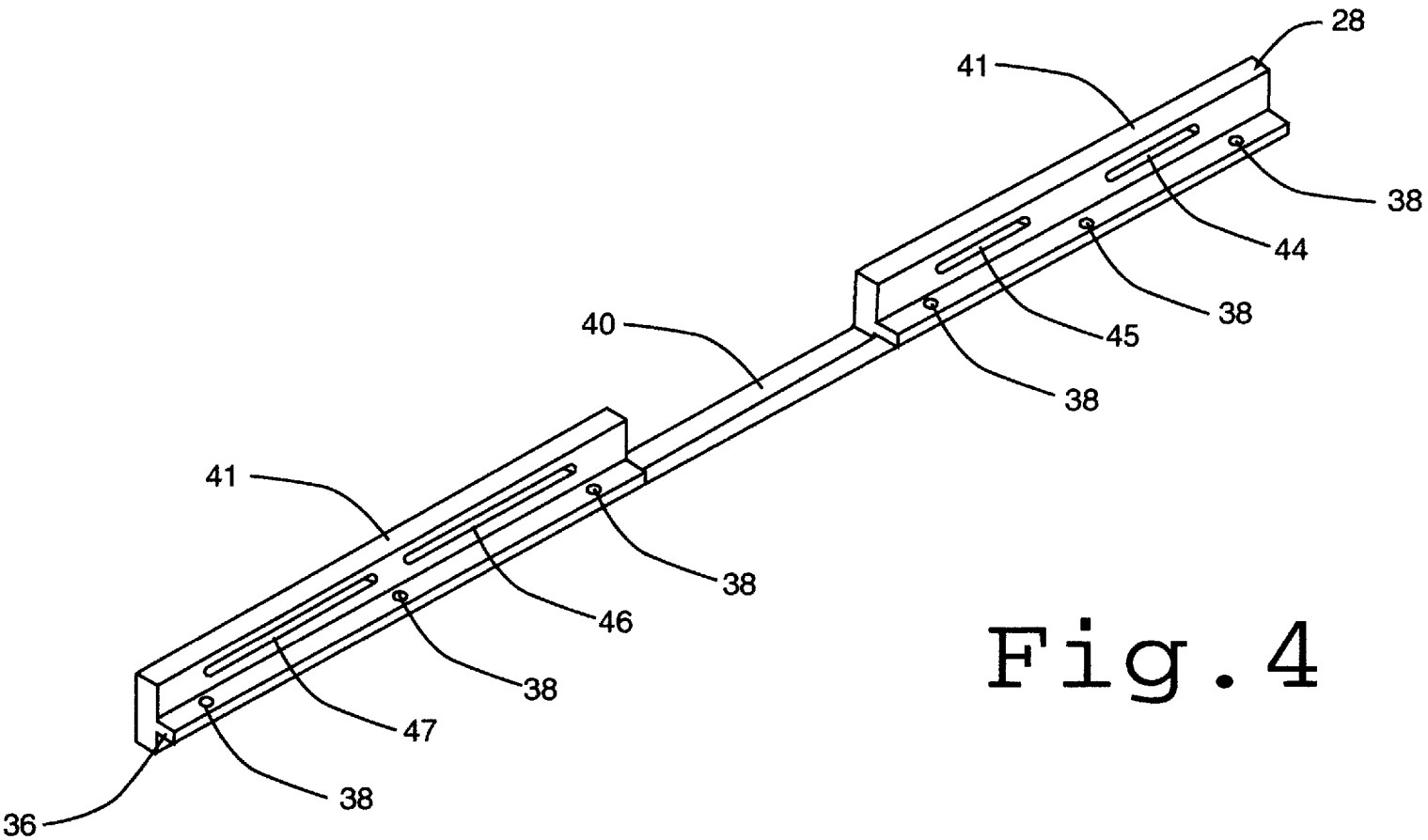
FIG. 4 is a back perspective view of the base fence unit of FIG. 3.
Figure 8:
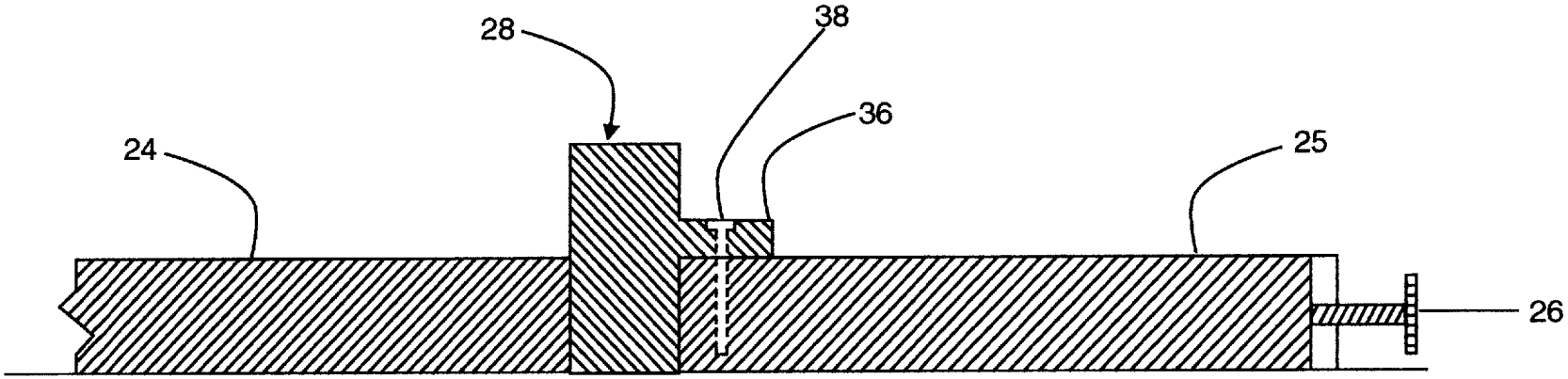
FIG. 8 is a cross sectional view of the base fence unit of the miter fence system of the present invention installed on a radial arm saw table.

A miter fence system 10 in accordance with the present invention is shown in more detail in FIG. 2. The major components of the miter fence system 10 include a base fence unit 28, miter arm base units 30 and 31, swinging miter arm units 32 and 33, and miter gauge slides 34 and 35. The miter fence system 10 is secured to the radial arm saw table 22 at the base fence unit 28 which is shown in more detail in FIGS. 3 and 4. The base fence unit may preferably be approximately 38 inches long. The base fence unit 28 includes a self squaring lip portion 36 which preferably extends from the back of the base fence unit 28 slightly above the bottom of the base fence unit 28. As shown in FIG. 8, when installed on the radial arm saw table 22, the portion of the base fence unit 28 below the self-squaring lip portion 36 is the portion of the miter fence system 10 which rests and is secured between the front and back work surfaces 24 and 25 of the saw table 22. The bottom of the self-squaring lip portion 36 thus rests on the top of the back work surface 25 of the saw table 22 when the miter fence system 10 is installed. As an alternative to, or in addition to, securing the miter fence system 10 to the radial arm saw 12 by effectively clamping the base fence unit 28 between the front and rear work surfaces 24 and 25, mounting holes 38 are preferably provided in the self-squaring lip portion 36 whereby the miter fence system 10 may be secured to the radial arm saw table 22 by passing screws or other fasteners through the mounting holes 38 into the top surface of the work table 22.

Near the center of the base fence unit 28 is an open portion 40. The open portion 40 may preferably be approximately 8½ inches wide. The open portion 40 is aligned with the path of the saw blade 18, and reduces the height of the base fence unit 28 in the area of the open portion 40 so that, when the blade 18 passes over the base fence unit 28, the blade 18 does not contact or damage the base fence unit 28. Thus, the open portion 40 of the base fence unit 28 preferably does not extend above the surface of the radial arm saw table 22. On either side of the open portion 40 are protruding portions 41 of the base fence unit 28 which do extend above the surface of the saw table 22. The protruding portions 41 may be approximately 2¼" high. Note that the open portion 40 is preferably sufficiently wide such that a variety of attachments to the radial arm saw motor 16, such as wide blades for making dado or rabbet cuts, may be used without contacting the protruding portions 41 or otherwise causing damage to the base fence unit 28. Similarly, the open portion 40 is also preferably wide enough to allow the saw blade 18 to be tilted to either side to make compound miter cuts without the blade contacting the protruding portions 41.

The miter arm base units 30 and 31 are attached to the base fence unit 28 in a manner which allows the miter arm base units to be slid in a direction toward or away from the path of the saw blade 18 (i.e., slid in the directions indicated by arrows 42 and 43 in FIG. 1) and to be securely locked in position relative to the base fence unit 28 when the desired position is reached. This combined sliding/locking feature may preferably be achieved by cutting key hole slots 44, 45, and 46, 47 through the left-hand and right-hand protruding portions 41, respectively, of the base fence unit 28 above the self-squaring lip portion 36. The key hole slots 44–47 extend entirely through the base fence unit 28. The miter arm base units 30 and 31 are secured to the base fence unit 28 by passing half threaded bolts 48, or other fasteners, through fastener holes 50 on the miter arm base units 30 and 31 and through the corresponding key hole slots 44–47 of the base fence unit 28. Threaded tightening knobs 52 are then attached to the threaded ends of the bolts 48. The threaded tightening knobs 52 are an example of a locking means for securing the miter arm base units 30 and 31 in position with respect to the base fence unit 28. It is apparent that when the tightening knobs 52 are loosened, the miter arm base units 30 and 31 may be slid back and forth along the base fence unit 28, with the bolts 48 or other fasteners sliding in the key hole slots 44–47. The length of the key hole slots 44–47 thus determines the amount of sliding movement of the miter arm base units 30 and 31 to the left and right which is allowed. Slots of 4 to 6 inches in length may preferably be used. When the miter arm base units 30 and 31 are in their desired positions, the tightening knobs 52 are tightened on the threaded ends of the bolts 48, thereby securing the miter arm base units 30 and 31, locking them into position on the base fence unit 28. The structures described in this paragraph, such as the keyhole slots 44–47, the half threaded bolts 48, the fastener holes 50, and the threaded tightening knobs 52, perform the function of attaching the miter arm base units 30 and 31 to the base fence unit 28 such that the miter arm base units 30 and 31 are slidably attached along the base fence unit 28 to adjust a position of the miter arm base units 30 and 31 with respect to the open portion 40 of the base fence unit 28 and fixedly attached in position with respect to the base fence unit 28 when the positioning of the miter arm base units 30 and 31 is complete. These exemplary structures may thus be referred to as sliding/locking attachment means for performing the function described. Although not shown, washers may be used in association with the bolts 48 and tightening knobs 52 in the conventional manner. Note also that, although the use of bolts and key hole slots to secure the miter arm base units 30 and 31 to the base fence unit 28 is preferred, it is apparent that other methods of securing the miter arm base units 30 and 31 to the base fence unit 28 may also be used in accordance with the present invention. For example, brackets may be used which are secured to the miter arm base units 30 and 31 and which overhang the top of the base fence unit 28 and are secured to the top or back surface of the base fence unit 28. This is another example of a sliding/locking attachment means.

Figure 5:
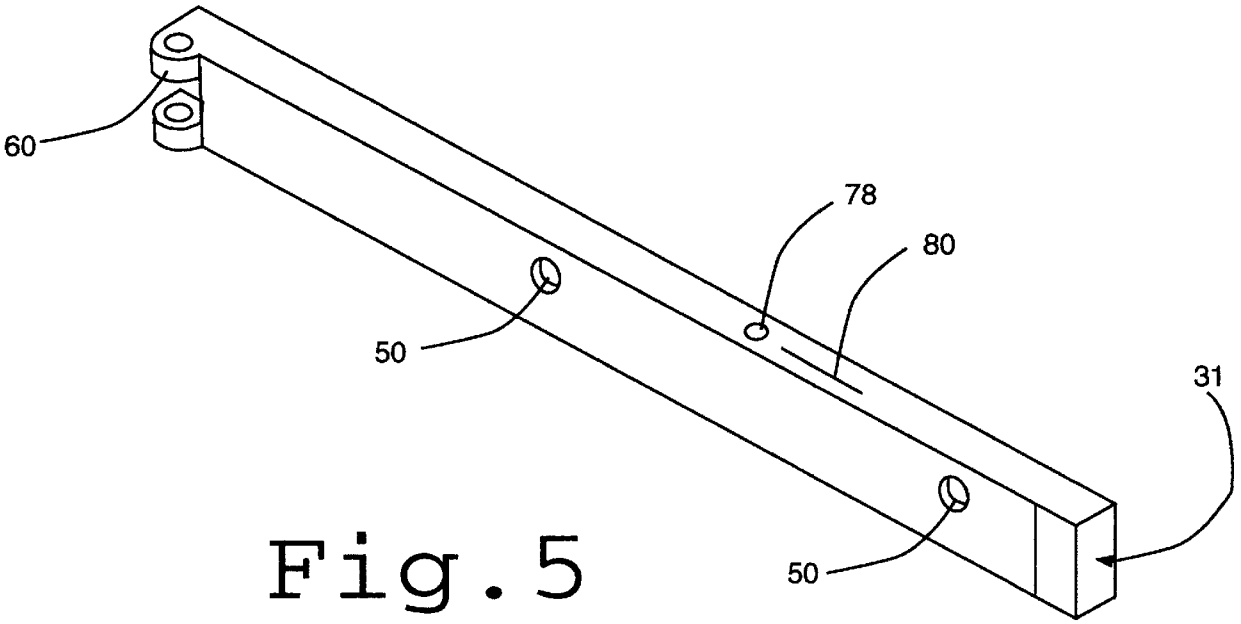
FIGS. 5 and 5A are a front perspective view and front view, respectively, of a miter arm base unit for the miter fence system of the present invention.
Figure 5A:
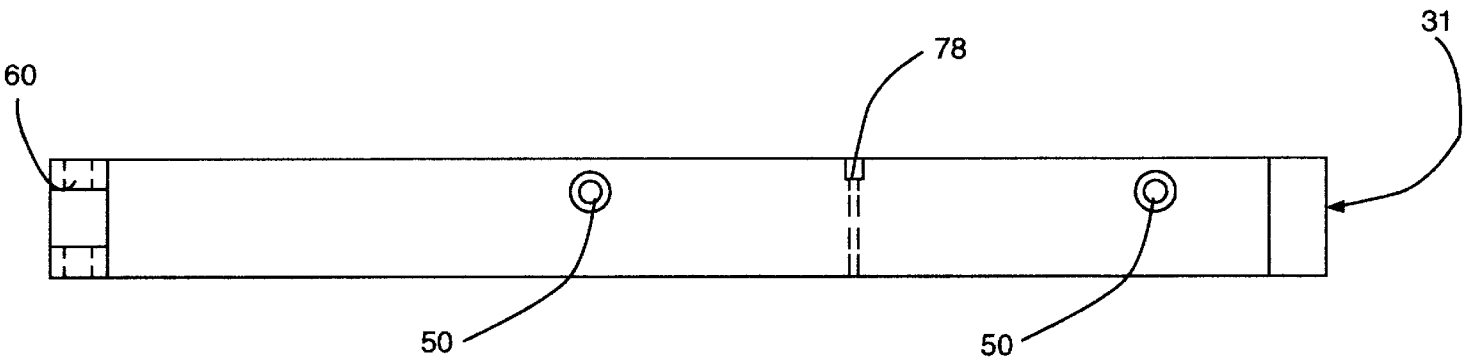

The right miter arm base unit 31 is shown in more detail in FIGS. 5 and 5A. The left miter arm base unit 30 will be of a similar design. Although not shown, the fastener holes 50 in the miter arm base unit 31 may preferably include a counter sunk hex pattern. This pattern would match the hex heads of bolts 48 which are used to secure the miter arm base unit 31 to the base fence unit 28. This would allow the tightening knobs 52 to be tightened without causing the bolts 48 to rotate in the fastener holes 50. Also, since the fastener holes 50 are counter sunk, the heads of the bolts 48 will not interfere with the motion of the swinging miter arm unit 32 and 33 which may be swung into position up against the miter arm base units 30 and 31 for the making of straight right angle cross cuts using the miter fence system 10 of the present invention. Note also that preferably at least two fastener holes 50 and corresponding bolts 48 are used to secure each miter arm base unit 30 or 31 to the base fence unit 28. Although only one bolt per miter arm base unit 30 or 31 could be used, the use of at least two such connection points greatly increases the stability of the miter arm base units 30 and 31. This is particularly true when the miter arm base units 30 or 31 are extended far into the open portion 40 of the base fence unit 28, close to the path of the radial arm saw blade 18. In such a situation, a relatively large amount of torque will be placed on the end of the miter arm base units 30 and 31 near the path of the saw blade 18 as the work piece is pressed tightly against the swinging miter arm unit 32 or 33 at the extended end of the miter arm base unit 30 or 31 near the point of the cut. In such a situation, the use of a single connection point between the miter arm base unit 30 or 31 and the base fence unit 28 may not provide the desired amount of stability to allow a clean cut to be made.

Figure 6:
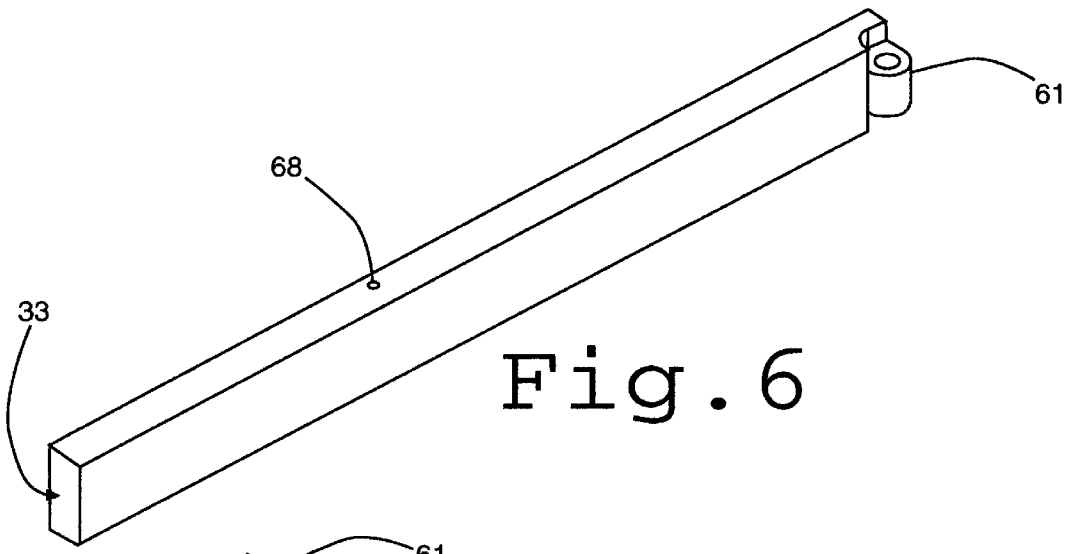
FIGS. 6 and 6A are back and front perspective views, respectively, of a swinging miter arm unit for the miter fence system of the present invention.
Figure 6A:
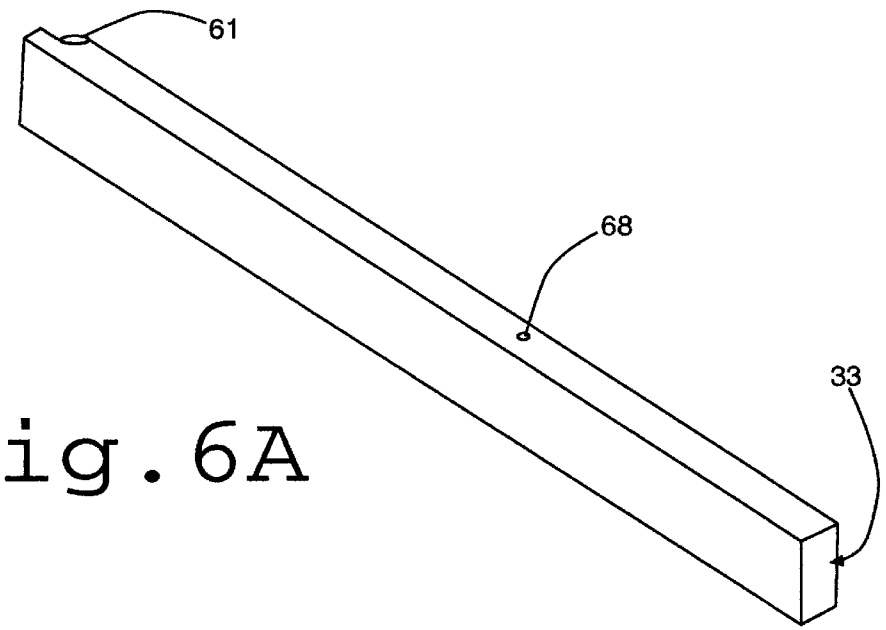

Attached to each miter arm base unit 30 and 31 is a swinging miter arm unit 32 or 33. The right swinging miter arm unit 33 is shown in more detail in FIGS. 6 and 6A. The left swinging miter arm unit 32 is similar. The swinging miter arm units 32 and 33 form the actual guide fence against which a work product is placed to hold the work product steady while being cut by the radial arm saw blade 18. The swinging miter arm units 32 and 33 are attached in a hinged relation to the miter arm base units 30 and 31 at the ends of the miter arm base units 30 and 31 and the swinging miter arm units 32 and 33 which are closest to the path of the radial arm saw blade 18. The hinged connections 54 and 55 allow the swinging miter arm units 32 and 33, respectively, to be moved in an angular direction, as shown by arrows 56, 57, 58 and 59 of FIG. 1. This allows the swinging miter arms 32 and 33 to form guide fences of any desired angle. When the swinging miter arm units 32 and 33 are moved adjacent to the miter arm base units 30 and 31, they form a straight guide fence for right angle cross cuts. Note that the hinged connections 54 and 55 between the miter arm base units 30 and 31 and the swinging miter arm units 32 and 33 may be implemented in a variety of ways. As shown, the hinged connection 55 includes integrally formed hinge sections 60 and 61 on the miter arm base unit 31 and swinging miter arm unit 33, respectively. The hinged connection 55 may thus be formed by joining the hinge sections 60 and 61 with a hinge pin 62, as shown in FIG. 2. This type of hinge connection is particularly appropriate where the miter arm base units 30 and 31 and swinging miter arm units 32 and 33 are molded from plastic or other similar materials wherein the hinge sections 60 and 61 may be easily integrally formed as part of the miter arm base units 30 and 31 and swinging miter arm units 32 and 33. Alternatively, a more traditional hinge connection may be used by, for example, using a standard hinge with one hinge plate mounted to the miter arm base unit 30 or 31 and the other hinge plate mounted to the swinging miter arm unit 32 or 33. This type of connection may be found particularly useful in miter fence systems 10 wherein the miter arm base units 30 and 31 and swinging miter arm units 32 and 33 are made of wood or metal.

Figure 7:
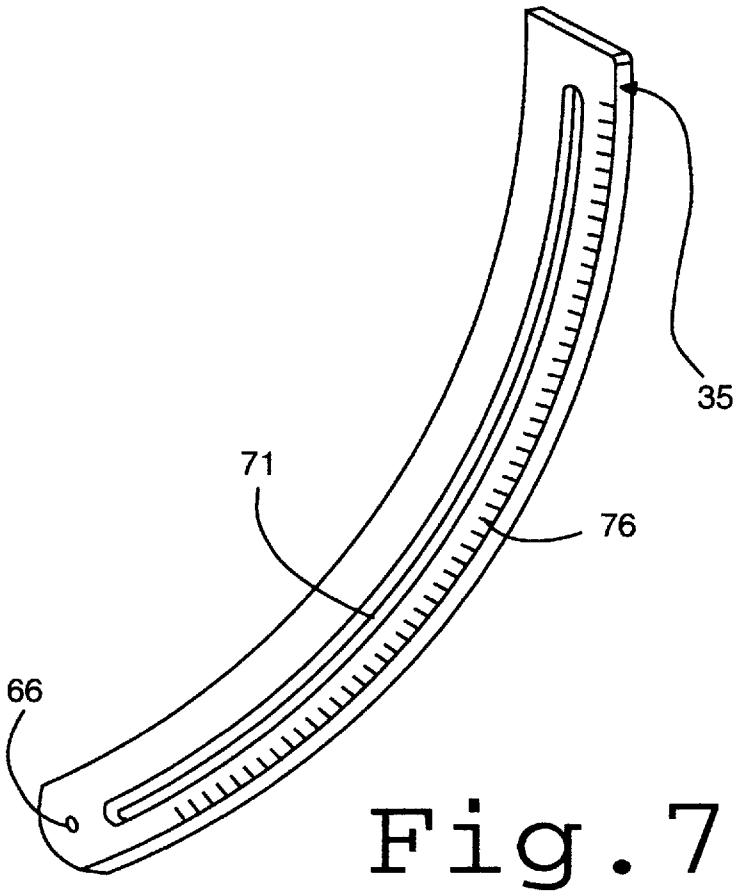
FIG. 7 is a perspective view of a miter gauge slide for the miter fence system of the present invention.

Along the length of the miter arm base units 30 and 31 and swinging miter arm units 32 and 33, the swinging miter arm units 32 and 33 are connected to the miter arm base units 30 and 31 at a second point. This second connection may be implemented in any manner which allows the swinging miter arm units 32 and 33 to move at the hinged connections 54 and 55 in order to adjust the angle of the swinging miter arm units 32 and 33, and which also allows the swinging miter arm units 32 and 33 to be locked into position at a desired angle. A preferred structure for this second connection between the miter arm base units 30 and 31 and the swinging miter arm units 32 and 33 is implemented using the miter gauge slides 34 and 35. The right miter gauge slide 35 is shown in more detail in FIG. 7. The left miter gauge slide 34 is similar. The miter gauge slides 34 and 35 are secured at one end of the miter gauge slides 34 and 35 to the swinging miter arm units 32 and 33, respectively. This connection may be made by use of a bolt, screw, or other fastener which is passed through a mounting hole 66 in the end of the miter gauge slide 34 or 35 into a corresponding hole in the swinging miter arm units 32 or 33. Alternatively, and preferably, the miter gauge slide 34 or 35 is attached to the swinging miter arm units 32 or 33 by a wide-capped pin 64 which is inserted through the mounting hole 66 drilled through the end of the miter gauge slide 34 or 35 into a locking cylinder 68 which is set into the top of the swinging miter arm unit 32 or 33. This arrangement allows the end of the miter gauge slides 34 or 35 to rotate around the pin 64 when the swinging miter arm unit angle is adjusted.

As shown, the miter gauge slide 34 or 35 is preferably semi-circular in shape. A slot 70 or 71 is cut or stamped through the miter gauge slide 34 or 35, respectively. The slot 70 or 71 is wide enough to accommodate a threaded bolt pin 72. The threaded bolt pin 72 is mounted in a bolt pin hole 78 on the top of the miter arm base unit 30 or 31, with the threaded portion of the bolt pin 72 extending from the miter arm base unit 30 or 31. The miter gauge slide 34 or 35 is positioned such that the bolt pin 72 is located in the slot 70 or 71. A wing nut 74, threaded knob, or similar device is then threaded onto the threaded end of the bolt pin 72. When the wing nut 74 is loosened, the angle of the swinging miter arm units 32 and 33 may be changed by rotating the swinging miter arm units 32 and 33 at the hinged connections 54 and 55 with the slots 70 and 71 in the miter gauge slides 34 and 35 sliding along the bolt pins 72. When the swinging miter arm units 32 and 33 are set in a desired position, the wing nut 74 is tightened down against the miter gauge slides 34 and 35, thereby locking the miter gauge slides 34 and 35 against the miter arm base units 30 and 31 and locking the swinging miter arm units 32 and 33 into the desired angle position. The threaded bolt pin 72, mounted in the bolt pin hole 78, and the wing nut 74, form an exemplary connection and locking means for connecting the miter gauge slides 34 and 35 to the miter arm base units 30 and 31. The wing nut 74 is an example of a threaded locking means for locking the miter gauge slides 34 and 35 into place. Note that the length of the miter gauge slides 34 and 35, and the length of the slot 70 and 71 in these slides, determines the maximum angles through which the swinging miter arm units 32 and 33 may be adjusted. Marked degree increments 76 may be stamped or printed on the top surface of the miter gauge slides 34 and 35 so that precise miter cuts of known angles may be made by aligning the markings 76 on the miter gauge slides 34 and 35 with a corresponding mark 80 on the miter arm base units 30 or 31. The structures described in this and the immediately preceding paragraph, including the miter gauge slides 34 and 35, the wide-capped pin 64, the mounting holes 66, the locking cylinder 68, the threaded bolt pin 72, the threaded bolt pin holes 78, and the wing nut 74, perform the function of connecting the swinging miter arm units 32 and 33 to the miter arm base units 30 and 31 such that the swinging miter arm units 32 and 33 are movably connected to the miter arm base units 30 and 31 to adjust the angle of the swinging miter arm units 32 and 33 with respect to the miter arm base units 30 and 31 and such that the swinging miter arm units 32 and 33 are lockable in position when the adjustment of the angle is complete. These exemplary structures may thus be referred to as miter gauge slide means for performing the function described.

An example of the use of the miter fence system 10 of the present invention to make a left angle cut is now described. The wing nut 74 is loosened and the angle of the swinging miter arm unit 32 is adjusted by rotating the swinging miter arm unit 32 with respect to the miter arm base unit 30 at the hinge connection 54. When the desired angle is set, the wing nut 74 is tightened down onto the miter gauge slide 34, thereby preventing further angular movement of the swinging miter arm unit 32. The threaded tightening knobs 52 are then loosened, and the miter arm base unit 30 is slid along the base fence unit 28 until the hinged end of the miter arm base unit 30 is close to, but not overlapping, the path of the radial arm saw blade 18. The threaded tightening knobs 52 are then tightened, fixing the miter arm base unit 30 in place. A work product, such as a piece of wood, is then placed against the angled fence formed by the swinging miter arm unit 32 which is now fixed in position. The end of the work product will extend beyond the end of the swinging miter arm unit 32, into the open portion 40 of the base fence unit 28, and thus into the path of the radial arm saw blade 18. The radial arm saw motor 16 and blade 18 are then brought forward along the radial arm 14 to cut the end of the work piece at the desired angle. The ability to adjust the position of the radial arm saw base unit 30 allows the fence formed by the swinging miter arm unit 32 to be brought close to the blade 18 to provide better support for the work product near the point of the cut. Similarly, the ability to adjust the position of the miter arm base units 30 and 31 allows the fences formed by the swinging miter arm units 32 and 33 to be moved away from the radial arm saw blade 18 when large blades or other radial arm saw attachments are used, or when the blade 18 is tilted to make a compound miter cut, thereby preventing any damage to the miter fence unit 10 from the blade 18. The ability to rapidly and easily adjust the angle of the fence formed by the swinging miter arm units 32 and 33 allows any angle cut, including 90° cross cuts, to be made using the miter fence system 10 of the present invention.

It should be noted that, although both left and right miter arm base units 30 and 31 and left and right swinging miter arm units 32 and 33 are shown, a miter fence unit in accordance with the present invention may be made having only a single, left or right, swinging miter arm unit and miter arm base unit. Of course, a miter fence system 10 preferably includes both left and right miter arm structures, thereby enabling both left and right angle cuts to be set and made using a single miter fence system 10.

It should also be noted that, although the use of a miter arm base unit 30 or 31 is highly desirable, a miter fence system may be made in accordance with the present invention by fixing the miter arm base units 30 and 31 in a set position against the miter arm base unit 28, or even by fixing the swinging miter arm units 32 and 33 in a hinged relation directly to the base fence unit 28. In such a case, the hinged connection would be made to the protruding portion 41 near the open portion 40 of the base fence unit 28. The miter gauge slides 34 and 35 would then connect the swinging miter arm units 32 and 33 directly to the base fence unit 28. Thus, the bolt pin 72, passing through the slot 70 or 71 in the miter gauge slide 34 or 35, would be fixed in the top surface of the base fence unit 28. This alternative configuration allows adjustment of the angle of the swinging miter arm units 32 and 33 with respect to the base fence unit 28. Thus, miter cuts of various angles may be easily made. However, the inability to effectively adjust the size of the open portion 40 in the base fence unit 28 limits the effectiveness of this alternative design. If the size of the open portion 40 is fixed too large, there will not be sufficient support for the work product at the point of the saw cut. Alternatively, if the open portion 40 is made too narrow, the radial arm saw blade 18 may contact the miter fence system 10, thereby damaging the miter fence system 10. This will be a particular problem where wide saw attachments are used or where compound miter cuts are attempted.

The miter fence system 10 of the present invention may be made out of a variety of materials. For example, the miter fence system 10 may be a hard wooden structure with metal hinges. Alternatively, the miter fence system 10 could be made of extruded or cast metal. Preferably, the miter fence system 10 may be made of high strength plastic using an injection or other molding process. By such a process, the hinge sections 60 and 61 may be integrally formed as part of the miter arm base units 30 and 31 and swinging miter arm units 32 and 33. Of course, a combination of materials may be used to form the miter fence system 10 of the present invention. For example, the miter arm base units 30 and 31 and swinging miter arm units 32 and 33 may be made of injection molded plastic, with the miter gauge slides 34 and 35 made of stamped cast metal.

Finally, it should also be noted that, although the miter fence system of the present invention is described with reference to a radial arm saw, it could also be adapted for use with other power saws or similar equipment wherein a work piece is required to be held in place with respect to a moving saw blade or other attachment. For example, the miter fence of the present invention could be used with a powered chop-type miter saw or similar device.

It is understood that this invention is not confined to the particular embodiments herein illustrated and described, but embraces such modified forms thereof as come within the scope of the following claims.

What is claimed is:

1. A miter fence system, comprising:

(a) a base fence unit including a protruding portion which extends above a surface of a saw table when the base fence unit is secured to the saw table and an open portion which does not extend above the surface of the saw table when the base fence unit is secured to the saw table;

(b) a miter arm base unit slidably attached to the protruding portion of the base fence unit and having a first end and a second end;

(c) a swinging miter arm unit having a first end which is attached in a hinged relation to the first end of the miter arm base unit and a second end; and (d) miter gauge slide means for attaching the swinging miter arm unit to the miter arm base unit, wherein the miter gauge slide means is attached between a point on the miter arm base unit intermediate the first end and the second end of the miter arm base unit and a point on the swinging miter arm unit intermediate the first end and the second end of the swinging miter arm unit.

2. The miter fence system of claim 1 wherein the base fence unit includes a self-squaring lip portion extending from a side of the base fence unit, the self-squaring lip portion including mounting holes through which fasteners may be placed to secure the base fence unit to the saw table.

3. The miter fence system of claim 1 wherein the base fence unit includes slots through the protruding portion of the base fence unit and wherein the miter arm base unit is attached to the base fence unit by fasteners which pass through fastener holes in the miter arm base unit and through the slots in the base fence unit and which terminate in locking means for securing the miter arm base unit in position with respect to the base fence unit.

4. The miter fence system of claim 1 wherein the miter gauge slide means for attaching the swinging miter arm unit to the miter arm base unit includes:

(a) a miter gauge slide including an end which is attached to the swinging miter arm unit and a slot formed in the miter gauge slide; and (b) connection and locking means for connecting the miter gauge slide to the miter arm base unit, the connection and locking means extending through the slot formed in the miter gauge slide.

5. The miter fence system of claim 4 wherein the connection and locking means includes a threaded bolt pin secured to the miter arm base unit and extending through the slot formed in the miter gauge slide and a threaded locking means for locking the miter gauge slide into place, wherein the threaded locking means is mounted on the threaded bolt pin.

6. The miter fence system of claim 4 wherein the miter gauge slide includes angle markings.

7. The miter fence system of claim 1 wherein the miter arm base unit and the swinging miter arm unit are made of molded plastic, wherein a hinge portion is integrally formed on the first end of the miter arm base unit and the first end of the swinging miter arm unit, and wherein the miter arm base unit and the swinging miter arm unit are attached in a hinged relation by a hinge pin passed through the integrally formed hinge portions of the miter arm base unit and the swinging miter arm unit.

8. The miter fence system of claim 1 wherein the open portion of the base fence unit is positioned in a center of the base fence unit and wherein a miter arm base unit and a swinging miter arm unit are attached to protruding portions of the base fence unit on each side of the open portion.

* * * * *